US005492421A

United States Patent [19]

Fushimi et al.

[11] Patent Number: 5,492,421

[45] Date of Patent: Feb. 20, 1996

[54] TRANSFER PRINTER

[75] Inventors: Kazuhiro Fushimi; Satoshi Kitahara, both of Mishima; Hiroyasu Ishii, Numazu, all of Japan

[73] Assignee: Kabushiki Kaisha TEC, Shizuoka, Japan

[21] Appl. No.: 408,202

[22] Filed: Mar. 22, 1995

[30] Foreign Application Priority Data

Mar. 25, 1994 [JP] Japan ..... 6-056203

[51] Int. Cl.[6] ..... B41J 3/02

[52] U.S. Cl. ..... 400/120.02; 400/120.16; 400/175; 400/692; 400/208; 400/196; 400/223

[58] Field of Search ..... 400/120.02, 120.03, 400/120.04, 120.16, 120.17, 692, 175, 207, 208, 196, 223; 346/76.1

[56] References Cited

U.S. PATENT DOCUMENTS

| | | | |
|---|---|---|---|
| 4,388,628 | 6/1983 | Moriguchi et al. | 400/120.02 |
| 4,896,166 | 1/1990 | Barker et al. | 346/76 PH |
| 5,106,215 | 4/1992 | Kitahara et al. | 400/175 |
| 5,157,415 | 10/1992 | Seyasu | 400/120.17 |
| 5,160,205 | 11/1992 | Mistyurik | 400/120.16 |
| 5,180,236 | 1/1993 | Kitahara et al. | 400/120.16 |

*Primary Examiner*—Eugene H. Eickholt
*Attorney, Agent, or Firm*—Frishauf, Holtz, Goodman, Langer & Chick

[57] ABSTRACT

A transfer printer comprises a printer body having first and second support frames separated from and opposing to each other. A printing portion includes a platen roller supported by the first and second support frame, and a line thermal head having one end portion supported by the first support frame and a free end located near the second support frame. A ribbon magazine having an ink ribbon is detachably fitted in the printer body from a free end side of the thermal head. The first support frame has first magazine positioning pins for engaging the support body of the fitted ribbon magazine to position and support the ribbon magazine. The second support frame has second magazine positioning pins for engaging the support body of the fitted ribbon magazine to position and support the ribbon magazine. The support body of the ribbon magazine has head positioning pins for engaging the free end of the thermal head to position and support the free end.

12 Claims, 6 Drawing Sheets

TRANSFER PRINTER

BACKGROUND OF THE INVENTION

1. Field of the Invention

The present invention relates to a transfer printer in which paper is inserted between a printing head and a platen and printing is performed on the paper with the printing head by using an ink ribbon.

2. Description of the Related Art

As a transfer printer of this type, for example, U.S. Pat. No. 5,106,215 discloses a printer which has an ink ribbon magazine detachably fitted to the printer body and which performs printing with a thermal head by using an ink ribbon withdrawn from the magazine.

An ink ribbon magazine has a pair of side plates coupled to each other to oppose each other, a supply reel and a take-up reel rotatably supported between these side plates, and a plurality of guide rollers. The unused portion of an ink ribbon is wound on the supply reel in a roll manner, and the portion of the ink ribbon used for printing is taken up by the take-up reel.

The printer body incorporates a printing portion having a thermal head and a platen roller opposing the thermal head, a support arm for supporting the ribbon magazine, a ribbon driving mechanism for driving the supply reel and take-up reel of the ribbon magazine, a pair of parallel support frames supporting the printing portion, the support arm, and the ribbon driving mechanism, and the like.

In order to facilitate mounting and removal of the ink ribbon magazine on and from the printer body, the thermal head and the support arm are cantilevered by one support frame. More specifically, each of the thermal head and the support arm has one end fixed to one support frame, and a non-held free end located adjacent to the other support frame. In mounting, the ink ribbon magazine is inserted in the printer body from the free end side of the support arm and mounted on the support arm, and is coupled to the ribbon driving mechanism provided on one support frame. At this time, the ink ribbon of the ink ribbon magazine is inserted between the thermal head and the platen roller from the free end side of the thermal head.

A support plate is pivotally mounted on the other support frame. After the ink ribbon magazine is mounted in the printer body, this support plate is pivoted to become parallel to one support frame and is engaged with the free ends of the support arm and thermal head, thereby supporting these free ends. Thus, each of the support arm and the thermal head is pseudo-supported at its two ends by one support frame and the pivotal support plate.

In the transfer printer, when the platen roller and the thermal head have small widths (in a direction perpendicular to the paper convey direction), the parallel degree between the platen roller, the thermal head, and the ink ribbon supplied from the ink ribbon magazine is not so decreased as to pose a problem. For this reason, even if the thermal head and the ink ribbon magazine are cantilevered, printing quality is no so degraded. When, however, the platen roller and the thermal head have lengths of about 100 mm (abut 4 inch), with the cantilever structure, the parallel degree between the platen roller, the thermal head, and the ink ribbon is largely impaired. Therefore, a degradation in printing quality becomes large, leading to a problem.

As described above, when a pivotal support plate is provided at the support frame of the printer body and the thermal head and the ribbon magazine are supported at their two ends, the parallel degree can be maintained. With this arrangement, however, the support plate must be pivoted when mounting and removing the ink ribbon magazine, degrading the operability. Since the pivotal support plate is provided, the number of components is increased and the arrangement becomes complicated.

SUMMARY OF THE INVENTION

The present invention has been made in view of the above problems, and has as its object to provide a transfer printer which has a simple arrangement, can be operated easily, and can maintain a high printing quality.

In order to achieve the above object, according to the present invention, there is provided a transfer printer comprising:

a printer body having a first support portion and a second support portion opposing the first support portion with a distance;

a printing portion including a platen supported by the first and second support portions, and a printing head, having one end portion supported by the first support portion and a free end located on a second support portion side, and opposing the platen;

a covey mechanism for conveying paper through a portion between the printing head and the platen;

a ribbon magazine detachably mounted in the printer body from a free end side of the printing head, for supplying an ink ribbon to a portion between the paper and the printing head, the ribbon magazine having a supply reel on which an unused portion of the ink ribbon is wound, a take-up reel for taking up a used portion of the ink ribbon, and a support body for rotatably supporting the supply reel and the take-up reel; and a ribbon driving mechanism provided on the first support portion, for driving the supply reel and the take-up reel of the mounted ribbon magazine;

the first support portion having a first magazine engaging portion for engaging the support body of the mounted ribbon magazine to position and support the ribbon magazine, the second support portion having a second magazine engaging portion for engaging the support body of the mounted ribbon magazine to position and support the ribbon magazine, and the support body of the ribbon magazine having a head support portion for engaging the free end of the printing head to position and support the free end.

According to the printer having the above arrangement, when the ink ribbon magazine is fitted to the printer body, the support body of the ink ribbon magazine is engaged with the first and second magazine engaging portions of the printer body, so that it is supported by the printer body and positioned with respect to the platen. Simultaneously, the head support portion of the support body is engaged with the free end of the printing head to position and support this free end. During this operation, the ink ribbon of the ink ribbon magazine is inserted between the printing head and the platen.

When the ink ribbon magazine is positioned by the first and second magazine engaging portions with respect to the platen, and the free end of the printing head is positioned and supported by the ink ribbon magazine positioned in this manner, the platen, the printing head, and the ink ribbon located between them are positioned to be parallel to one another. Accordingly, high-quality printing can be performed.

These supporting and positioning operations are automatically performed only by fitting the ink ribbon magazine into the printer body. Therefore, unlike in a conventional printer, a separately provided support member need not be pivoted, so that the ink ribbon magazine can be mounted and removed easily.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 7B show a color printer according to an embodiment of the present invention, in which:

FIG. 1 is a partially cutaway side view schematically showing the entire structure of the color printer;

FIG. 2 is a sectional view taken along a line II—II in FIG. 1;

FIG. 3 is a sectional view corresponding to FIG. 2, from which the ink ribbon magazine is removed;

FIG. 4 is a schematic enlarged side view of a printing portion;

FIG. 5 is a side view of printing portions and ink ribbon magazines;

FIG. 6 is an exploded perspective view showing part of a ribbon save mechanism; and FIGS. 7A and 7B are front and side views, respectively, of an ink ribbon magazine.

DETAILED DESCRIPTION OF THE PREFERRED EMBODIMENT

An embodiment of the present invention will be described in detail with reference to the accompanying drawings.

Figure 1:
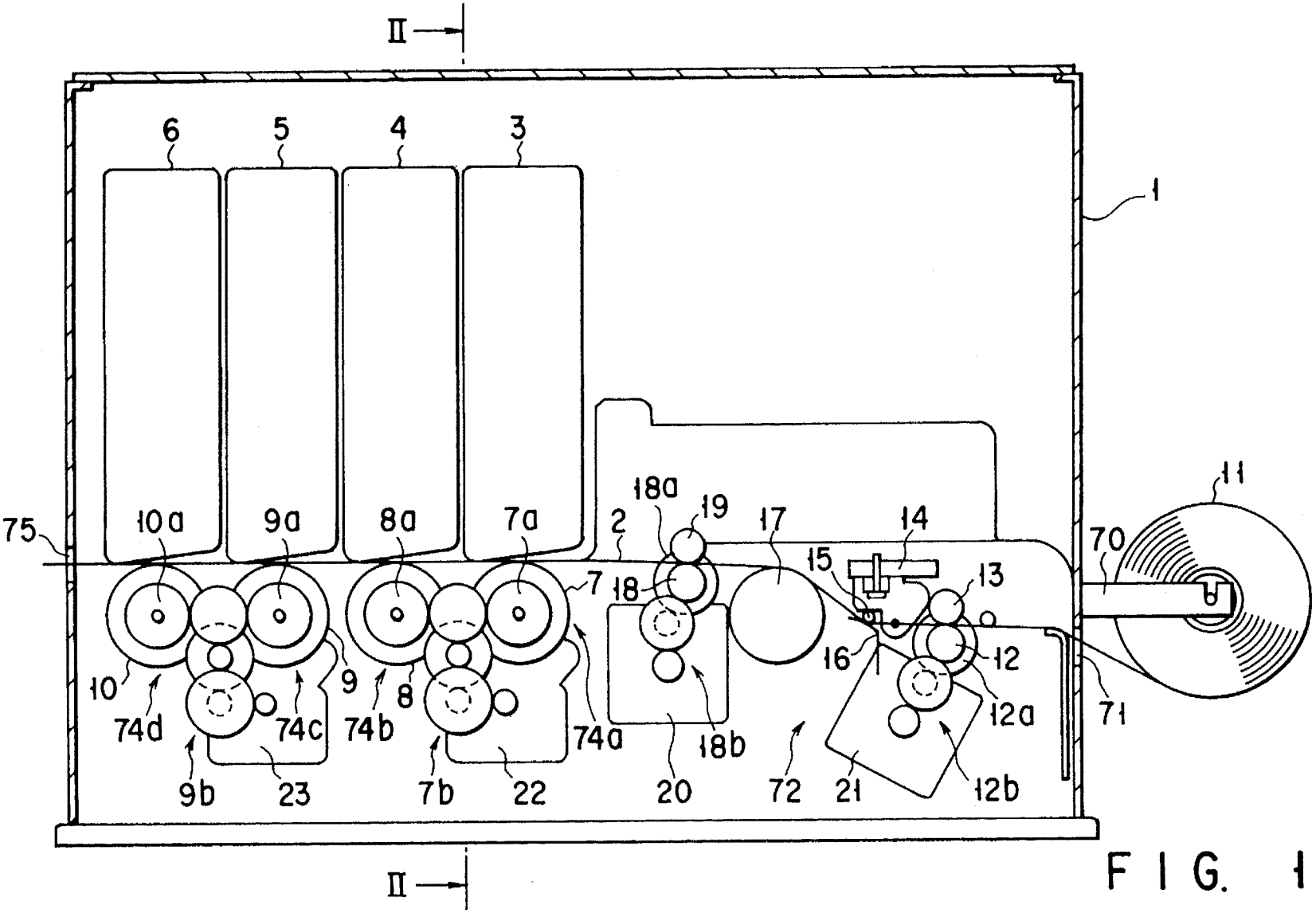

FIG. 1 shows a single path type color printer wherein four printing portions are sequentially provided along a paper convey path and paper is convey through the printing portions in turns. The color printer has a substantially rectangular box-shaped printer body 1, and support arms 70 constituting a holding portion project from one side wall of the printer body 1. A paper roll 11 obtained by rolling continuous paper is rotatably supported by the support arms 70.

In the printer body 1, a convey mechanism 72, first to fourth printing portions 74*a* to 74*d*, and first to fourth detachable ink ribbon magazines 3 to 6 are provided. The convey mechanism 72 withdraws the paper from the paper roll 11 and conveys it along a predetermined convey path 2. The first to fourth printing portions 74*a* to 74*d* are sequentially located along the convey path 2 from the convey mechanism 72 side. The first to fourth ink ribbon magazines 3 to 6 are located to respectively oppose the first to fourth printing portions 74*a* to 74*d*. The paper withdrawn from the paper roll 11 by the convey mechanism 72 is taken into the printer body 1 through an insertion port 71, and is sequentially conveyed to the first to fourth printing portions 74*a* to 74*d* along the convey path 2. Desired images are printed on the paper at the respective printing portions 74*a* to 74*d*. Thereafter, the paper is discharged through a discharge port 75 formed in the printer body 1.

As shown in FIG. 1, the convey mechanism 72 has a first convey roller 18, a press roller 19, a second convey roller 12, a press roller 13, guide rollers 15 and 17, and a guide plate 16. The first convey roller 18 is provided adjacent to the first printing portion 74*a*. The press roller 19 is in rolling contact with the first convey roller 18 at a predetermined pressure. The second convey roller 12 is provided on the paper roll 11 side with respect to the first convey roller 18. The press roller 13 is in rolling contact with the second convey roller 12 at a predetermined pressure. The guide rollers 15 and 17 are provided between the first and second convey rollers 18 and 12. The guide plate 16 is provided to oppose the guide roller 15.

Figure 2:
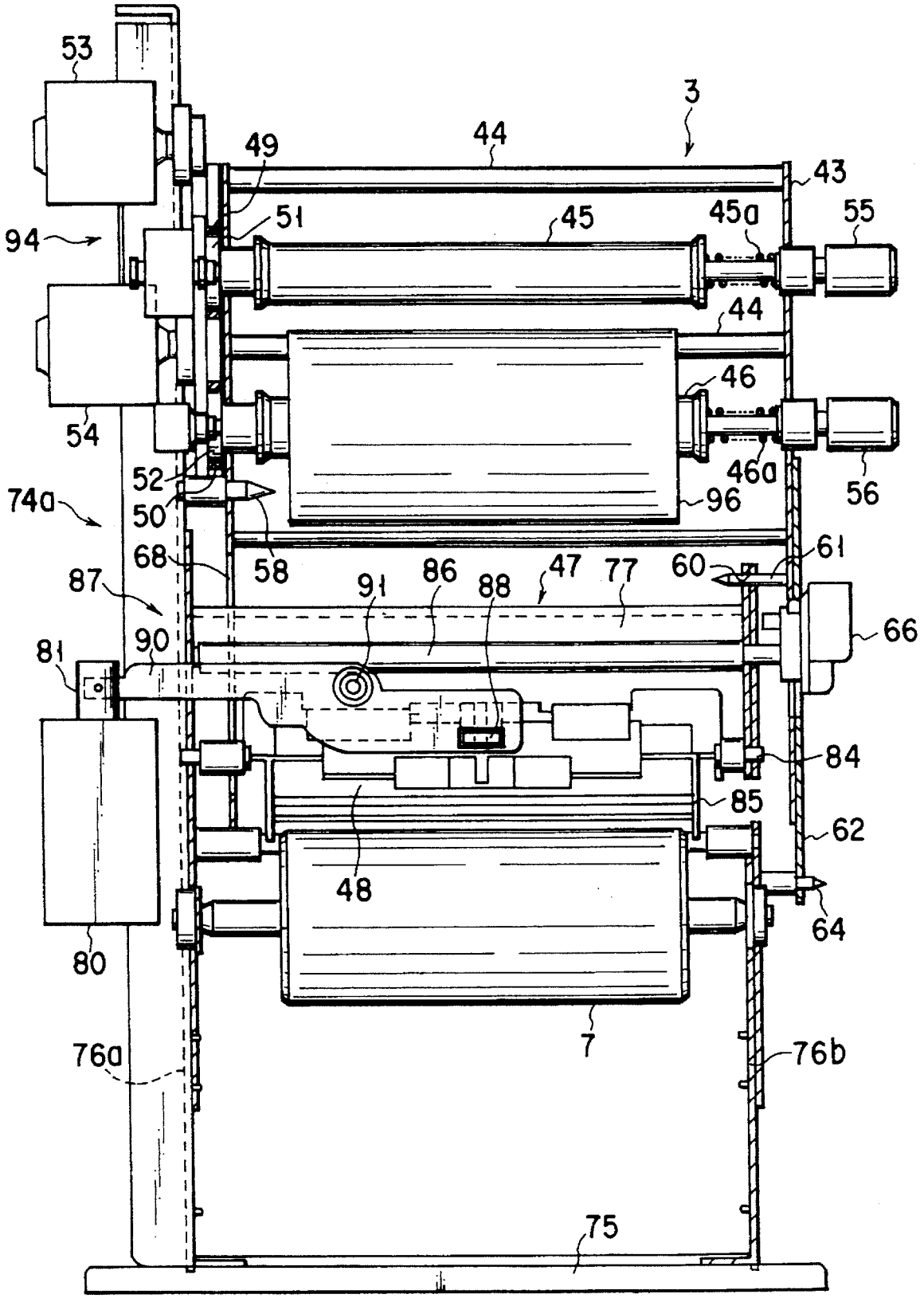

As shown in FIGS. 1 and 2, the printer body 1 has a base 75 and first and second support frames 76*a* and 76*b* vertically provided upright on the base 75. The second support frame 76*b* is formed lower than the first support frame 76*a*, and is separated from and opposes the lower half of the first support frame 76*a* to be parallel to it. The first and second convey rollers 18 and 12, the press roller 19, and the guide rollers 15 and 17 are rotatably supported between the parallel support frames 76*a* and 76*b* of the printer body 1, and extend in a direction perpendicular to the paper convey direction.

As shown in FIG. 1, a gear 18*a* is fixed to the rotating shaft of the first convey roller 18, and is connected to the rotating shaft of a first stepping motor 20 mounted on the second support frame 76*b* through a gear train 18*b*. Thus, the first convey roller 18 is rotated by the first stepping motor 20 at a predetermined peripheral speed. Similarly, a gear 12*a* is fixed to the rotating shaft of the second convey roller 12, and is connected to the rotating shaft of a second stepping motor 21 mounted on the second support frame 76*b* through a gear train 12*b*. The second convey roller 12 is rotated by the second stepping motor 21 at a predetermined peripheral speed.

When the second convey roller 12 is rotated, the paper is conveyed while being sandwiched between the second convey roller 12 and the press roller 13, and is withdrawn from the paper roll 11. Subsequently, the paper passes between the guide roller 15 and the guide plate 16 and along the guide roller 17, and is supplied to a portion between the first convey roller 18 and the press roller 19. Furthermore, the paper is conveyed to the printing portions by the convey force of the first convey roller 18.

A tension detection unit 14 is provided between the first and second convey rollers 18 and 12, and particularly between the guide roller 15 and the second convey roller 12, to detect the stretched/loosened state of the paper between them.

As shown in FIG. 1, the first to fourth printing portions 74*a* to 74*d* respectively include first to fourth platen rollers 7 to 10 disposed in a row under the paper convey path 2, and head blocks provided above the paper convey path 2 to oppose the corresponding platen rollers 7 to 10. The two end portions of each of the first to fourth platen rollers 7 to 10 are rotatably supported by the first and second support frames 76*a* and 76*b* of the printer body 1 as shown by the first platen roller 7 as the representative in FIG. 2. Each platen roller extends in a direction perpendicular to the paper convey direction. These platen rollers 7 to 10 have the same diameter, and are rotated by motors described later while their outer circumferential surfaces are in contact with the paper. The outer circumferential surface of each platen roller is formed to have a friction coefficient lower than that of the outer circumferential surface of the first convey roller 18.

The respective head blocks are not shown in FIG. 1 as they are housed in the ink ribbon magazines 3 to 6.

Gears 7*a* and 8*a* having different gear ratios are mounted on the rotating shafts of the platen rollers 7 and 8 of the first and second printing portions 74*a* and 74*b* that perform printing first and second, respectively. These gears 7*a* and 8*a* are connected to the rotating shaft of a third stepping motor 22 mounted on the support frame 76*b* of the printer body 1 through a gear train 7*b*. The first and second platen rollers 7 and 8 are driven by the third stepping motor 22 at different peripheral speeds.

Gears 9*a* and 10*a* having different gear ratios are mounted on the rotating shafts of the platen rollers 9 and 10 of the third and fourth printing portions 74*c* and 74*d* that perform printing third and fourth, respectively. These gears 9*a* and 10 are connected to the rotating shaft of a fourth stepping motor 23 mounted on the support frame 76*b* through a gear train 9*b*. The third and fourth platen rollers 9 and 10 are driven by the fourth stepping motor 23 at different peripheral speeds.

When the rotational speeds of the third and fourth stepping motors 22 and 23 and the gear ratios of the plurality of gears connected between the two stepping motors 22 and 23 and the platen rollers are adjusted, the peripheral speeds of the platen rollers 7 to 10 become higher than that of the first convey roller 18 and are sequentially increased in a printing order.

The head blocks of the printing portions opposing the corresponding platen rollers will be described. Since these head blocks have the same arrangement, a head block 47 of the first printing portion 74*a* will be described as the representative, and a description of the three remaining head blocks will be omitted.

Figure 3:
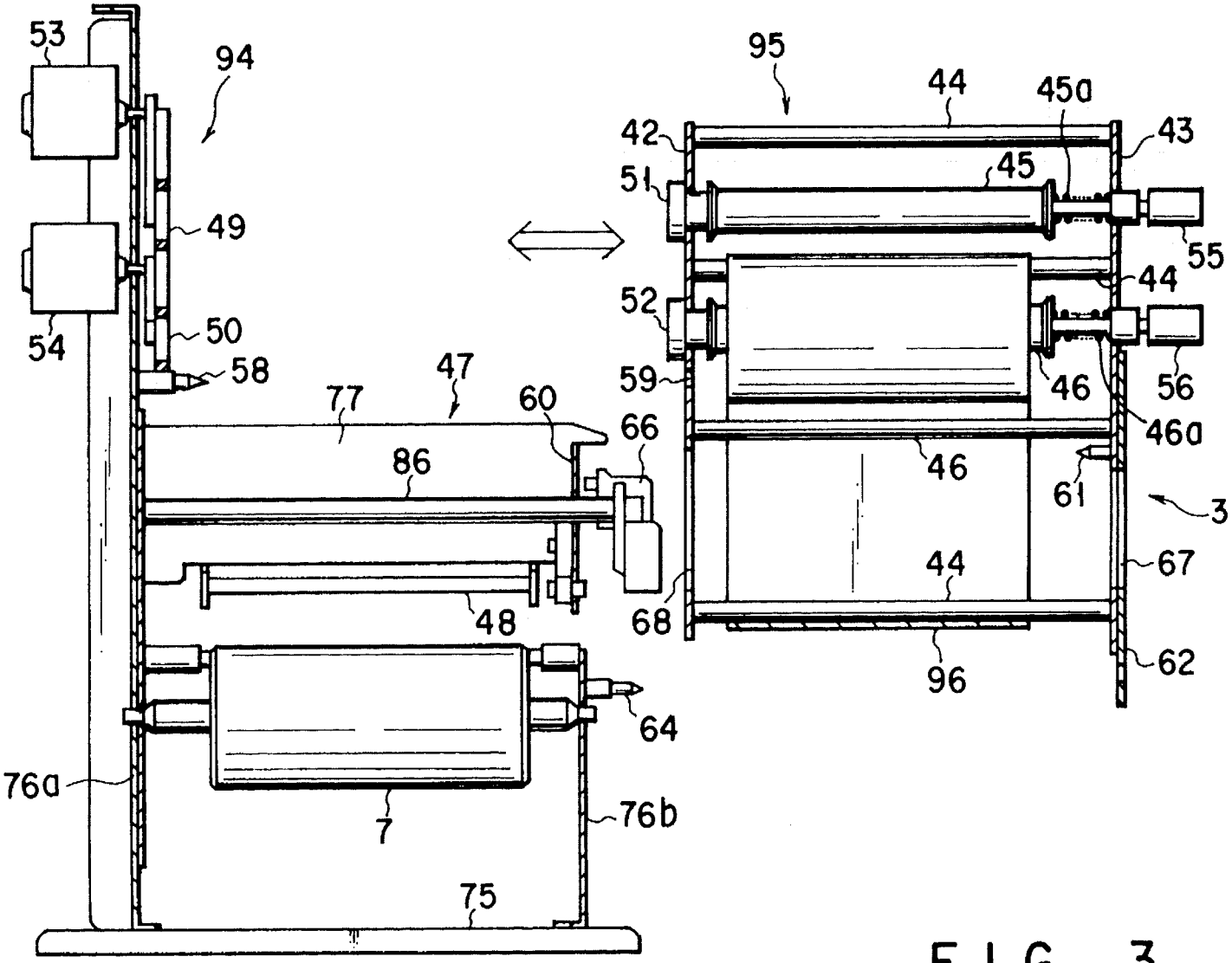
Figure 4:
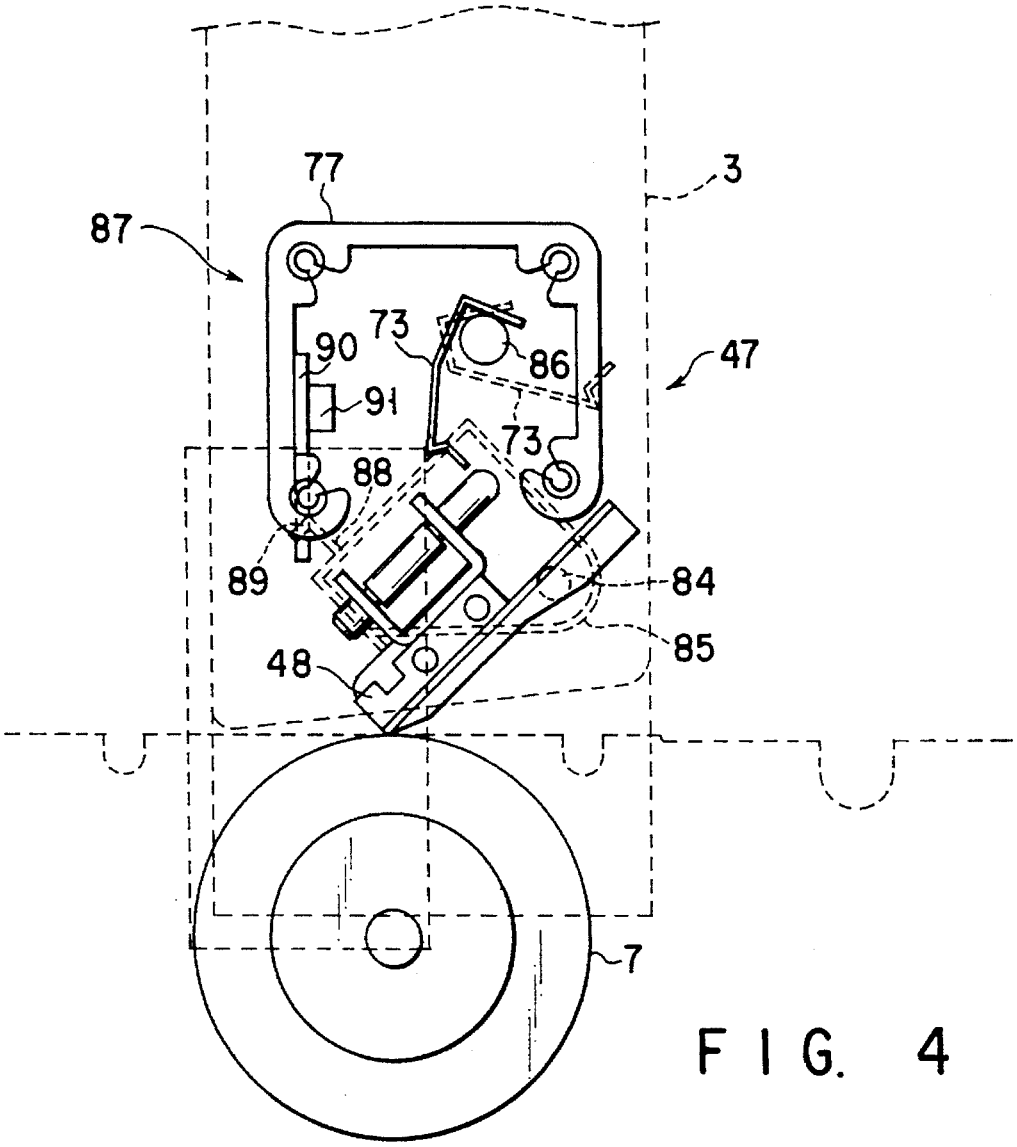

As shown in FIGS. 2 to 5, the head block 47 has an elongated stationary frame 77. The stationary frame 77 has one end fixed to the first support frame 76*a* of the printer body 1 and the other end extending above the second support frame 76*b*. A head mounting plate 85 is rotatably supported by the stationary frame 77 through a rotating shaft 84. The head block 47 has a line thermal head 48 serving as a printing head, and the thermal head 48 is mounted on the head mounting plate 85 and extends parallel to the platen roller 7. A head press spring 73 connected to a rotating shaft 86 of a head-up lever 66 is connected to the head mounting plate 85. One end of the rotating shaft 86 is fixed to the first support frame 76*a* to be cantilevered by it, and the free end thereof extends above the second support frame 76*b*. The head-up lever 66 is fixed to the free end of the rotating shaft 86 and is located outside the first support frame 76*a*. When the head-up lever 66 is rotated, the head press spring 73 is pivoted, and the head mounting plate 85 is pivoted about the rotating shaft 84 as the center. In FIG. 4, the head press spring 73 is located at a position indicated by the solid line when the thermal head 48 is at a printing position, and is located at a position indicated by the broken line when the thermal head 48 is at a release position.

Figure 5:
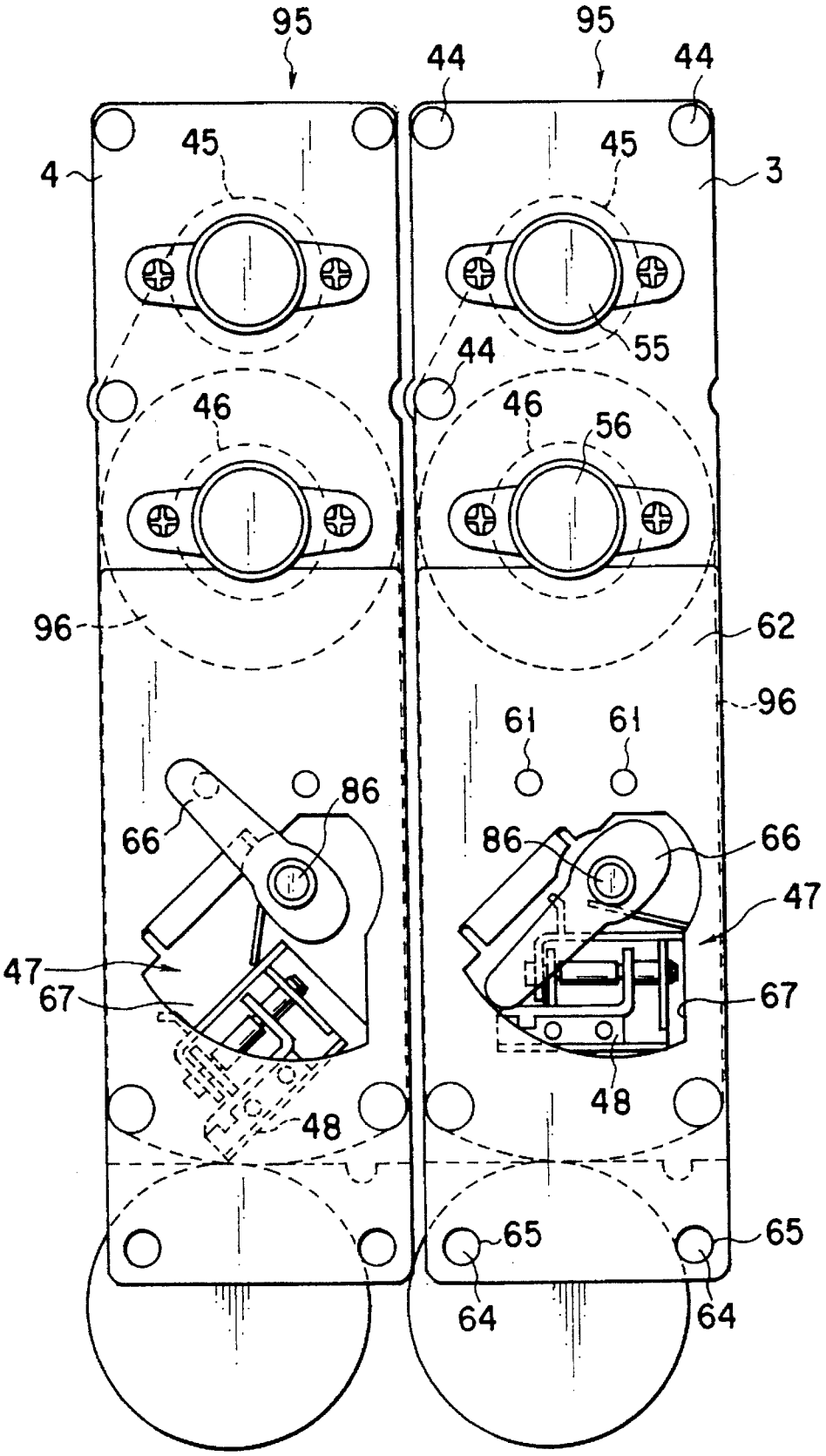

Thus, the thermal head 48 can be moved by a manual operation to either a printing position shown in FIG. 4, where it is brought into contact with the outer circumferential surface of the platen roller 7, and a release position shown in FIG. 5, where it is separated from the outer circumferential surface of the platen roller 7.

Furthermore, the head block 47 has a ribbon save mechanism 87 for saving the ink ribbon by automatically moving the thermal head 48 from the printing position to the release position.

Figure 6:
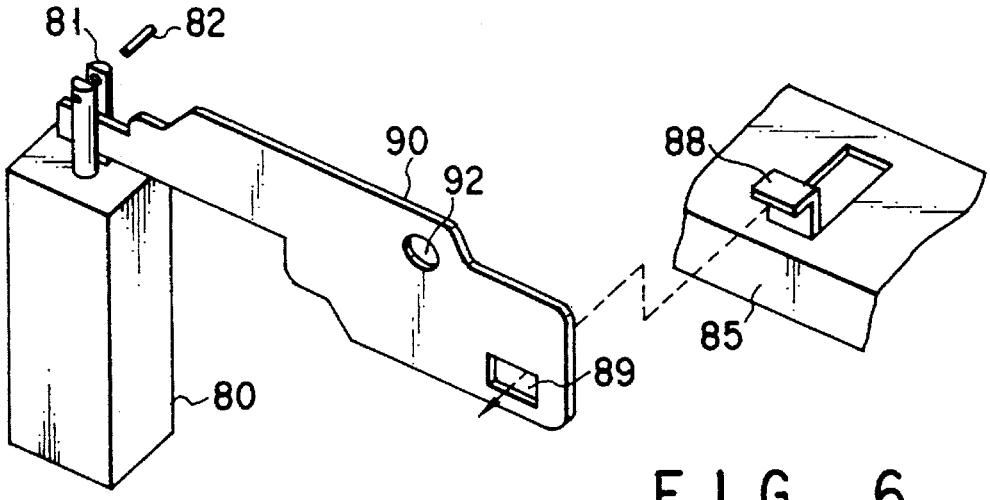

As shown in FIGS. 2, 4, and 6, the ribbon save mechanism 87 has a coupling pawl 88 projecting from the head mounting plate 85 and a transmission plate 90 having an engaging hole 89 in which the coupling pawl 88 is engaged. A transmission plate shaft 91 is provided at the stationary frame 77 fixed to the first support frame 76*a*. The transmission plate shaft 91 extends through a through hole 92 formed at the intermediate portion of the transmission plate 90 to pivotally support the transmission plate 90 on the stationary frame 77.

A plunger 81 of a self-hold solenoid 80 is connected to an end portion of the transmission plate 90 which is on the opposite side of the engaging hole 89 with respect to the through hole 92. The self-hold solenoid 80 is supported on the first support frame 76*a*. When the plunger 81 is driven in the retracting direction, the transmission plate 90 is pivoted about the transmission plate shaft 91 as the fulcrum, to move the coupling pawl 88 engaged in the engaging hole 89 upward, i.e., in a direction to separate from the platen roller 7. Thus, the head mounting plate 85 is pivoted upward against the biasing force of the head press spring 73, so that the thermal head 48 is moved to the release position.

When the plunger 81 is driven in the projecting direction, the coupling pawl 88 engaged in the engaging hole 89 is moved downward, i.e., toward the platen roller 7, thereby moving the thermal head 48 to the printing position through the head mounting plate 85.

Even when the thermal head 48 is set at the printing position by the head-up lever 66, it can be moved to the release position as required by energizing the solenoid 80 in the above manner.

Although not shown, the head blocks of the remaining printing portions have ribbon save mechanisms having the same arrangement. These ribbon save mechanisms can independently move the corresponding line thermal heads to the release position or the printing position in accordance with the printing data.

Each printing portion has a ribbon driving mechanism 94 provided at the upper half of the first support frame 76*a* of the printer body 1, as shown by the first printing portion 74*a* as the representative in FIG. 2. The ribbon driving mechanism 94 has a feed motor 54, a take-up motor 53, a feed coupler 50 rotated by the feed motor 54 through a gear train, and a take-up coupler 49 rotated by the take-up motor 53 through a gear train.

As shown in FIGS. 1 to 5, the first to fourth ink ribbon magazines 3 to 6 are detachably mounted in the printer body 1 and are located in series in this order above the paper convey path 2. These ink ribbon magazines 3 to 6 are mounted to cover the corresponding head blocks 47. Yellow, magenta, cyan, and black ink ribbons are set in the first to fourth ink ribbon magazines 3 to 6, respectively.

The arrangement of the ink ribbon magazines 3 to 6 will be described in detail by way of the first ink ribbon magazine 3 as the representative. As shown in FIGS. 2, 3, 5, 7A, and 7B, the ink ribbon magazine 3 has a ribbon frame 95 serving as a support body. The ribbon frame 95 has first and second elongated rectangular support plates 42 and 43. The first and second support plates 42 and 43 are coupled to each other through a plurality of reinforcing shafts 44 serving as coupling means, and oppose each other to be parallel to each other with a distance almost equal to the distance between the first and second support frames 76*a* and 76*b* of the printer body 1.

A take-up reel 45 for taking up the portion of an ink ribbon 96 used for printing and a supply reel 46 on which the unused portion of the ink ribbon 96 is wound are provided in substantially the upper half space between the first and second support plates 42 and 43. The two ends of each reel are rotatably supported by the first and second support plates 42 and 43. The take-up reel 45 and the supply reel 46 are arranged in a longitudinal row in the elongated direction of the first and second support plates 42 and 43, i.e., in the vertical direction at a minimum gap therebetween in accordance with the take-up diameter of the ink ribbon 96.

The ink ribbon 96 is fed from the supply reel 46, passes on the outer side of the two reinforcing shafts 44 provided at the lower end portion of the ribbon frame 95, and is taken up by the take-up reel 45 (see FIG. 5). A hollow portion 95*a* is defined in substantially the lower half of the ribbon frame 95. When the ink ribbon magazine 3 is fitted in the printer body 1, the head block 47 is housed in the hollow portion 95*a*.

Each of the rotating shafts of the take-up reel 45 and the supply reel 46 has an extended end portion extending outside the ribbon frame 95 through the first support plate 42, and coupling members 51 and 52 are fixed to the extended end portions, respectively. When the ink ribbon magazine 3 is mounted in the printer body 1, these coupling members 51 and 52 are coupled to the take-up coupler 49 and the feed coupler 50, respectively, of the ribbon driving mechanism 94 provided on the first support frame 76*a* of the printer body 1.

A take-up knob 55 and a feed knob 56 for rotating the take-up reel 45 and the supply reel 46, respectively, by a manual operation are mounted on the other end portion of the rotating shaft of the take-up reel 45 and to the other end portion of the rotating shaft of the supply reel 46, respectively, both other end portions extending outside through the second support plate 43. The take-up reel 45 and supply reel 46 are urged toward the coupling members 51 and 52 by compression springs 45*a* and 46*a* which are arranged on the rotating shafts of these reels and located between the reels and the second support plate 43, respectively.

Figure 7B:
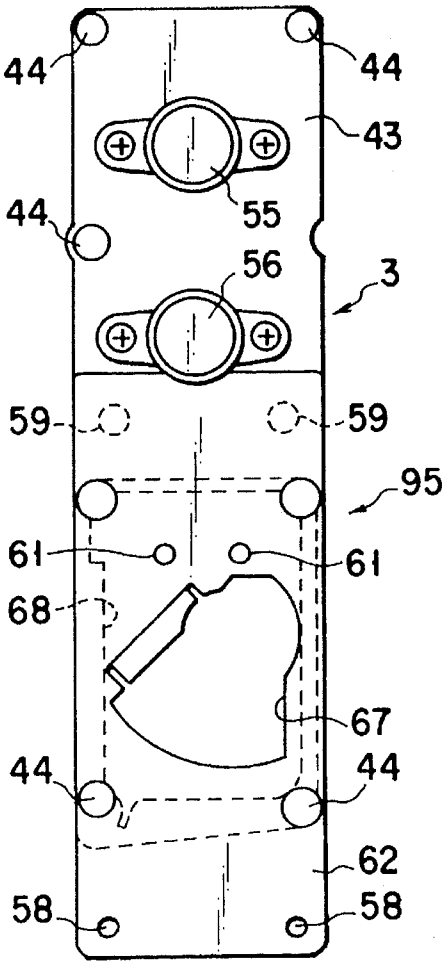
Figure 7A:
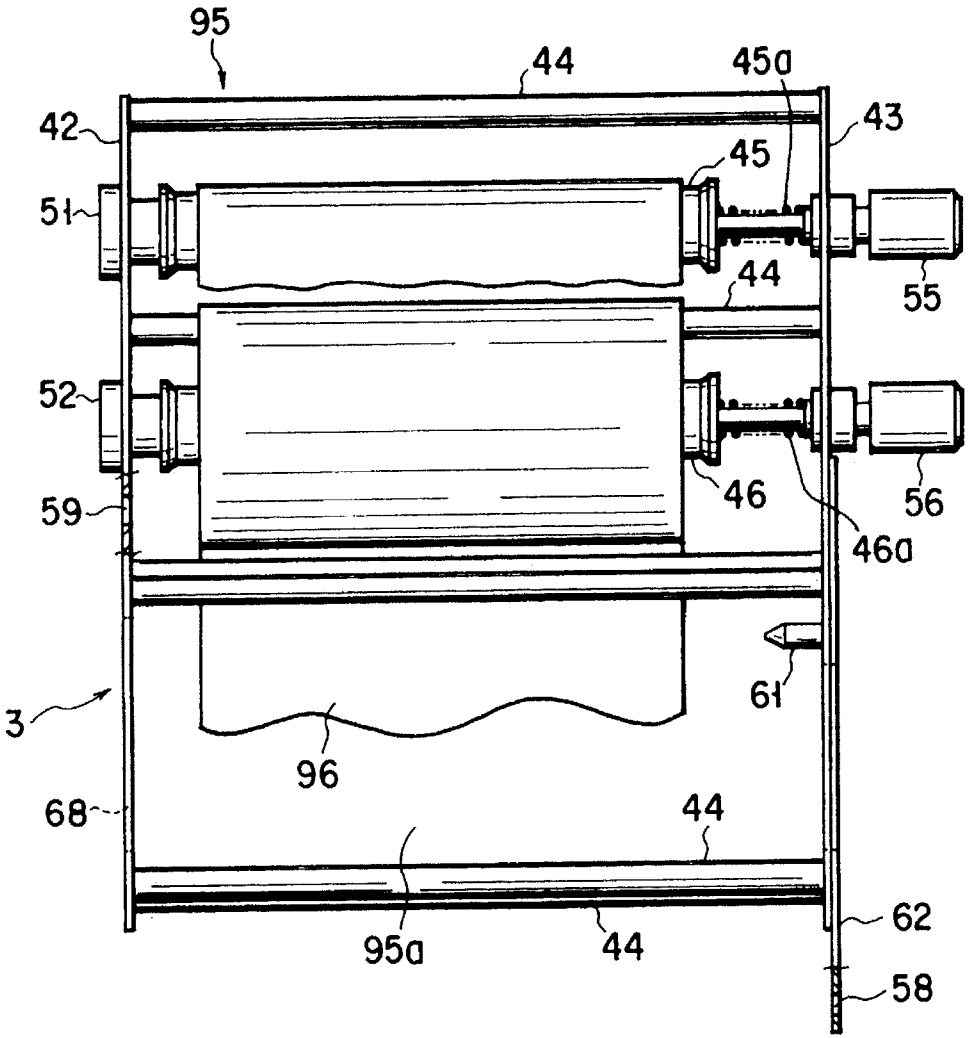

As is seen well from FIG. 7B, an opening 68 communicating with the hollow portion 95 is formed in the lower end portion of the first support plate 42. When the ink ribbon magazine 3 is fitted in the printer body 1, part of the head block 47 and part of the ribbon save mechanism 87 are inserted into the hollow portion 95*a* through the opening 68. A rectangular auxiliary plate 62 is fixed to the lower end portion of the second support plate 43 and extends downward beyond the lower end of the second support plate 43. The second support plate 43 and the auxiliary plate 62 may be integrally formed. An opening 67 communicating with the hollow portion 95*a* defined between the first and second support plates 42 and 43 is formed in each of the second support plate 43 and the auxiliary plate 62. When the ink ribbon magazine 3 is fitted in the printer body 1, the head-up lever 66, located at a position for moving the thermal head 48 to the release position, can pass through the openings 67 (see FIG. 5).

The printer body 1 and the ink ribbon magazine 3 have a plurality of engaging portions for supporting and positioning the ink ribbon magazine 3 on the printer body 1 when the ink ribbon magazine 3 is fitted in the printer body 1. As shown in FIGS. 2, 3, 7A, and 7B in detail, a pair of first magazine positioning pins 58 serving as a first magazine engaging portion are provided on the first support frame 76*a* of the printer body 1 to project toward the second support frame 76*b*. A pair of first positioning holes 59 serving as a first main body engaging portion are formed in the first support plate 42 of the ink ribbon magazine 3. When the ink ribbon magazine 3 is fitted in the printer body 1, the first magazine positioning pins 58 are fitted in the first positioning holes 59, respectively.

A pair of second magazine positioning pins 64 serving as a second magazine engaging portion are provided at the upper end portion of the second support frame 76*b* of the printer body 1 to project outward. A pair of second positioning holes 65 serving as a second main body engaging portion are formed in the second support plate 43 of the ink ribbon magazine 3. When the ink ribbon magazine 3 is mounted in the printer body 1, the second magazine positioning pins 64 are fitted in the second positioning holes 65, respectively. Furthermore, a pair of head positioning pins 61 serving as a head support portion are provided at the intermediate portion of the second support plate 43 to project toward the first support plate 42. A pair of head positioning holes 60 are formed in the free end of the head block 47, i.e., in the free end of the stationary frame 77. When the ink ribbon magazine 3 is mounted in the printer body 1, the head positioning pins 61 are fitted in the head positioning holes 60, respectively.

The second to fourth ink ribbon magazines 4 to 6 have the same arrangement as that of the first ink ribbon magazine 3 except for the colors (yellow, magenta, cyan, and black) of the ink ribbons mounted in them, and a detailed description thereof will be omitted.

In the color printer having the above arrangement, assume that the ink ribbon magazine 3 is to be mounted in the printer body 1. As shown in FIG. 3, the ink ribbon magazine 3 is held such that the first support plate 42 of the ribbon frame 95 faces the printer body 1 and that the take-up reel 45 and the supply reel 46 are located to be parallel to the platen roller 7, and the ink ribbon magazine 3 is inserted in the axial direction of the platen roller 7 from the free end side of the head block 47 cantilevered by the first support frame 76*a*. At this time, the thermal head 48 of the printer body 1 is held at the release position by pivoting the head-up lever 66 downward. The ink ribbon magazine 3 is moved into the printer body 1 such that the head block 47 including the thermal head 48 is housed in the hollow portion 95*a* through the opening 68 in the first support plate 42 of the ink ribbon magazine 3, and the ink ribbon magazine 3 is inserted until the head-up lever 66 projects outward through the opening 67 of the second support plate 43. The lower end portion of the ink ribbon 96 withdrawn from the supply reel 46 is inserted between the thermal head 48 and the platen roller 7 from the free end side of the thermal head 48.

When the ink ribbon magazine 3 is inserted to a predetermined position, the first magazine positioning pins 58 provided at the first support frame 76*a* of the printer body 1 are fitted in the first positioning holes 59 of the first support plate 42 of the ink ribbon magazine 3, and the second magazine positioning pins 64 provided at the second support frame 76*b* of the printer body 1 are fitted in the second positioning holes 65 of the second support plate 43 of the ink ribbon magazine 3. Simultaneously, the head positioning pins 61 provided at the second support plate 43 of the ink ribbon magazine 3 are fitted in the head positioning holes 60 formed in the free end of the stationary frame 77 of the head block 47.

Accordingly, the first support plate 42 of the ink ribbon magazine 3 is supported and positioned on the first support frame 76*a* of the printer body 1 through engagement of the first magazine positioning pins 58 with the first positioning holes 59. The second support plate 43 of the ink ribbon magazine 3 is supported and positioned on the second support frame 76*b* of the printer body 1 through engagement of the second magazine positioning pins 64 with the second positioning holes 65. Thus, the ink ribbon magazine 3 is supported and positioned in the printer body 1, and is positioned at a predetermined position with respect to the platen roller 7.

The second support plate 43 of the ink ribbon magazine 3 which is supported and positioned in the printer body 1 in this manner supports and positions the free end of the cantilevered head block 47 through engagement of the head positioning pins 61 with the head positioning holes 60. Therefore, the head block 47 is supported and positioned on the second support frame 76*b* of the printer body 1 through the head positioning pins 61, the head positioning holes 60, the second support plate 43, the auxiliary plate 62, the second positioning holes 65, and the second magazine positioning pins 64. As a result, the thermal head 48 is positioned and held at a predetermined position to be parallel to the platen roller 7 and the ink ribbon 96.

After the ink ribbon magazine 3 is mounted in the above manner, the head-up lever 66 is pivoted upward, as shown in FIG. 2 and the left side of FIG. 5, to set the thermal head 48 of the head block 47 at the printing position where it is in contact with the platen roller 7. The head-up lever 66 projects through the openings 67 of the second support plate 43 and the auxiliary plate 62. When the thermal head 48 is pivoted to the printing position, the head-up lever 66 is located outside the passing range of the opening 67 and is brought into contact with the outer surface of the auxiliary plate 62. Therefore, the ink ribbon magazine 3 is regulated from moving in the axial direction of the platen roller 7 (the widthwise direction of the thermal head 48), and is locked at the mounted position.

Other ink ribbon magazines 4 to 6 are also mounted in the predetermined positions of the printer body 1 in accordance with the same manner as the first ink ribbon magazine 3. Each of the ink ribbon magazine can be removed from the printer body 1 with an opposite procedure to that described above.

The ribbon save mechanism 87 constituted by the self-hold solenoid 80, the transmission plate 90, and the head mounting metal plate 85 is provided at each head block 47. Thus, in printing, a ribbon save operation for economizing the ink ribbon is executed by each head block in accordance with the printing data for the thermal head 48. In the ribbon save operation, the ribbon driving mechanism 94 is also stopped, so that feed of the ink ribbon is stopped.

In this manner, according to this embodiment, since the head block 47 including the thermal head 48 is cantilevered, the ink ribbon magazine 3 can be easily mounted in and removed from the printer body 1.

The first magazine positioning pins 58 are provided at the first support frame 76*a* of the printer body 1, the head positioning holes 60 are formed in the head block 47 including the thermal head 48 and the like, and the second magazine positioning pins 64 are provided at the second support frame 76*b*. In the ink ribbon magazine, the first positioning holes 59, to which the first magazine positioning pins 58 are fitted, are formed in the first support plate 42, and the head positioning pins 61 for fitting in the head positioning holes 60 and the second positioning holes 65 for receiving the second magazine positioning pins 64 are provided at the second support plate 43. For this reason, the ink ribbon magazine 3 can be supported and positioned with respect to the printer body 1 and the platen roller 7 only by mounting the ink ribbon magazine 3 in the printer body 1, and simultaneously the thermal head 48 can be positioned with respect to the ink ribbon magazine 3 and the platen roller 7. Accordingly, the ink ribbon magazine 3 can be mounted more easily, and the parallel degree between the platen roller 7, the thermal head 48, and the ink ribbon 96 supplied from the ink ribbon magazine 3 can be maintained at high precision.

The head-up lever 66 for moving the thermal head 48 between the printing position and the release position is provided on the head block 47. The opening 67, through which the head-up lever 66 can pass only when the thermal head 48 is at the release position, is formed in the ink ribbon magazine 3. When the thermal head 48 is moved to the printing position upon mounting the ink ribbon magazine 3, the head-up lever 66 is abutted against the auxiliary plate 62 to prevent the ink ribbon magazine 3 from being removed. The ink ribbon magazine 3 can be removed from the printer body 1 only when the thermal head 48 is at the release position.

Since the ribbon save mechanism 87 driven by the self-hold solenoid 80 is provided at each head block 47, the ribbon save operation can be freely performed by each head block in accordance with the printing data for the thermal head 48. Accordingly, necessary ink ribbon economization can be performed by each head block, thereby preventing waste of the ink ribbon with a higher reliability. Since the self-hold solenoid is used, power consumption can be economized, and unnecessary heat generation can be prevented.

As has been described above in detail, according to the present invention, there is provided a transfer printer in which the ink ribbon magazine can be mounted easily and which can perform high-quality printing while maintaining the parallel degree between the platen, printing head, and the ink ribbon supplied from the ink ribbon magazine.

The present invention is not limited to the embodiment described above, and various changes and modifications may be made within the spirit and scope of the invention. For example, the first and second magazine engaging portions provided at the support frame of the printer body may be engaging holes, and the main body engaging portions provided at the ink ribbon magazine side may be engaging pins. Similarly, the head positioning portion provided at the free end of the head block may be a pin, and the head support portion of the ink ribbon magazine side may be an engaging hole.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A transfer printer comprising:

a printer body having a first support portion and a second support portion separated from and opposing said first support portion;

a printing portion including a platen supported by said first and second support portions, and a printing head having one end portion supported by said first support portion and a free end located near the second support portion, and opposing said platen;

conveying means for conveying paper through a portion between said platen and said printing head;

a ribbon magazine detachably mounted in said printer body from a free end side of said printing head, for supplying an ink ribbon to a portion between the paper and said printing head, said ribbon magazine having a supply reel on which an unused portion of the ink ribbon is wound, a take-up reel for taking up a used portion of the ink ribbon, and a support body for rotatably supporting said supply reel and said take-up reel; and a ribbon driving mechanism provided on said first support portion, for driving said supply reel and said take-up reel of said mounted ribbon magazine;

the first support portion having a first magazine engaging portion for engaging said support body of said mounted ribbon magazine to position and support said ribbon magazine, the second support portion having a second magazine engaging portion for engaging said support body of said mounted ribbon magazine to position and support said ribbon magazine, and the support body of said ribbon magazine having a head support portion for engaging said free end of said printing head to position and support said free end.

2. A printer according to claim 1, wherein said support body of said ink ribbon magazine comprises first and second support plates separated from and opposing each other, and coupling means for coupling said first and second support plates with each other, said supply reel and said take-up reel are rotatably supported between said first and second support plates, said first support plate has a first main body engaging portion for engaging said first magazine engaging portion, and said second support plate has a second main body engaging portion for engaging said second magazine engaging portion, and said head support portion.

3. A printer according to claim 2, wherein said first magazine engaging portion has a first positioning pin projecting from said first support portion of said printer body toward said second support portion, said second magazine engaging portion has a second positioning pin projecting from said second support portion of said printer body outward, said first main body engaging portion has a first positioning hole formed in said first support plate for receiving said first positioning pin, and said second main body engaging portion has a second positioning hole formed in said second support plate for receiving said second positioning pin.

4. A printer according to claim 2, wherein said platen, printing head, supply reel, and take-up reel are arranged substantially in a row extending in a direction substantially perpendicular to a paper convey direction.

5. A printer according to claim 2, wherein said first support plate of said support body has a first opening through which said printing portion is inserted, and said second support plate has a second opening opposing the first opening, and said printing portion comprises a rotating shaft having one end rotatably supported by said first support portion of said printer body and a free end extending beyond said second support portion, for moving, by rotation thereof, said printing head between a printing position where said printing head is brought into contact with said platen and a release position where said printing head is separated from said platen, and a lever fixed to said free end of said rotating shaft and projecting outside said second support plate through said second opening of said support body, for rotating the rotating shaft and for engaging an outer surface of said second support plate to lock said mounted ink ribbon magazine, when said lever is rotated while said ink ribbon magazine is mounted in said printer body.

6. A printer according to claim 1, wherein said printing portion comprises support means for supporting said printing head to be movable between a printing position where said printing head is brought into contact with said platen, and a release position where said printing head is separated from said platen, and a save mechanism for moving said printing head to the release position when said ink ribbon is not used.

7. A printer according to claim 6, wherein said save mechanism has a transmission member connected to said printing head, and a self-hold solenoid for moving said printing head through said transmission member.

8. A color transfer printer comprising:

a printer body having a first support portion and a second support portion separated from and opposing said first support portion;

a plurality of printing portions each including a platen supported by said first and second support portions, and a printing head having one end portion supported by said first support portion and a free end located near said second support portion, and opposing said platen;

conveying means for conveying paper through a portion between said platen and said printing head of each of said printing portions;

a plurality of ribbon magazines each of which is detachably mounted in said printer body from a free end side of said printing head of a corresponding printing portion, for supplying an ink ribbon to a portion between the paper and said printing head, each of said ribbon magazines having a supply reel on which an unused portion of the ink ribbon is wound, a take-up reel for taking up a used portion of the ink ribbon, and a support body for rotatably supporting said supply reel and said take-up reel; and a plurality of ribbon driving mechanisms provided at said first support portion, for driving said supply reels and said take-up reels of the mounted ribbon magazines;

said first support portion having a plurality of first magazine engaging portions for engaging said support bodies of said mounted ribbon magazines to position and support said ribbon magazines, said second support portion having a plurality of second magazine engaging portions for engaging said support bodies of said mounted ribbon magazines to position and support said ribbon magazines, and said support body of each of said ribbon magazines having a head support portion for engaging said free end of a corresponding printing head to position and support said free end.

9. A printer according to claim 8, wherein said support body of each of said ink ribbon magazines comprises first and second support plates separated from and opposing each other, and coupling means for coupling said first and second support plates with each other, said supply reel and said take-up reel are rotatably supported between said first and second support plates, said first support plate has a first main body engaging portion for engaging said first magazine engaging portion, and said second support plate has a second main body engaging portion for engaging said second magazine engaging portion, and said head support portion.

10. A printer according to claim 9, wherein said platen and said printing head of each of said printing portions, and said supply reel and said take-up reel of said ink ribbon magazine which opposes said corresponding printing portion are arranged substantially in a row extending in a direction substantially perpendicular to a paper convey direction.

11. A printer according to claim 8, wherein each of said printing portions comprises support means for supporting said corresponding printing head to be movable between a printing position where said printing head is brought into contact with said platen, and a release position where said printing head is separated from said platen, and a save mechanism for moving said printing head to the release position when said ink ribbon is not used.

12. A printer according to claim 11, wherein said save mechanism has a transmission member connected to said printing head, and a self-hold solenoid for moving said printing head through said transmission member.

* * * * *